US005114546A

United States Patent [19]

Dapperheld et al.

[11] Patent Number: 5,114,546

[45] Date of Patent: May 19, 1992

[54] PROCESS FOR THE PREPARATION OF FLUORINATED ACRYLIC ACIDS AND DERIVATIVES THEREOF

[75] Inventors: Steffen Dapperheld, Kriftel; Rudolf Heumüller, Rodgau; Manfred Wildt, Brombachtal, all of Fed. Rep. of Germany

[73] Assignee: Hoechst Aktiengesellschaft, Frankfurt, Fed. Rep. of Germany

[21] Appl. No.: 777,488

[22] Filed: Oct. 15, 1991

Related U.S. Application Data

[63] Continuation of Ser. No. 532,914, Jun. 4, 1990, abandoned, which is a continuation of Ser. No. 246,363, Sep. 20, 1988, abandoned.

[30] Foreign Application Priority Data

Sep. 23, 1987 [DE] Fed. Rep. of Germany ..... 3731914

[51] Int. Cl.[5] ..... C25B 3/04

[52] U.S. Cl. ..... 204/72; 204/73 R; 204/81

[58] Field of Search ..... 207/72, 73 R, 80, 81

[56] References Cited

U.S. PATENT DOCUMENTS 4,098,657 7/1978 Kay et al. ..... 204/72
4,162,948 7/1979 Yagii et al. ..... 204/81
4,707,226 11/1987 Dapperheld ..... 204/81

FOREIGN PATENT DOCUMENTS 3607446 9/1987 Fed. Rep. of Germany .
2335477 7/1987 France .

OTHER PUBLICATIONS

C. Giomini et al., J. Chem. Research (M) pp. 2401–2416 (1983).

W. H. Jura et al., J. Amer. Chem. Soc. 80 pp. 5402–5409 (1958).

Elektroorganische Chemie, Fritz Beck, Verlag Chemie, 1974, pp. 210–214 and English Translation.

*Primary Examiner*—John Niebling
*Assistant Examiner*—Steven P. Marquis

[57] ABSTRACT

In the preparation processes known hitherto for haloacrylic acids and deuterated derivatives thereof, it is necessary to use chemicals, some of which are very toxic or very expensive.

However, fluoroacrylic acids are successively prepared from halogenated fluoropropionic acids and derivatives thereof by electrochemical elimination of halogen atoms.

For this purpose, the acids or derivatives thereof are electrolyzed in a water-containing solution at a temperature from −10° C. to the boiling point of the electrolysis liquid.

10 Claims, No Drawings

PROCESS FOR THE PREPARATION OF FLUORINATED ACRYLIC ACIDS AND DERIVATIVES THEREOF

This application is a continuation of application Ser. No. 07/532,914 filed Jun. 4, 1990, now abandoned which in is a continuation of Ser. No. 07/246,363, filed Jul. 2, 1988, now abandoned.

DESCRIPTION

The invention relates to an electrochemical process for the preparation of fluorinated acrylic acids and derivatives thereof by selective dehalogenation of halogen-containing fluoropropionic acids and derivatives thereof.

Acrylic and methacrylic acid derivatives have a very broad field of application as organic intermediates. They allow access to a large number of useful compounds, but are above all useful for the preparation of plastics.

For some time, there has been particular interest in halogenated and deuterated acrylic and methacrylic acid derivatives since such substances are suitable for the preparation of specific plastics having particular properties.

Thus, for example, α-haloacrylates are used for the preparation of radiation-sensitive protective coatings in resist technology. Specific α-fluoroacrylates are suitable, for example, for the preparation of plastic glasses for the aerospace industry and are, in addition, suitable starting materials for polymeric fiber optics, deuterated derivatives being particularly interesting due to their better optical properties.

It has been proposed to use halogenated fluorine-containing acrylic acid derivatives as starting compounds in the preparation of fluorinated acrylic acid derivatives, in particular also of correspondingly deuterated compounds (cf. German Offenlegungschrift 3,704,915).

It is furthermore known that halogenated fluorine-containing acrylic acid derivatives can be prepared by dehalogenating correspondingly halogenated fluoropropionic acid derivatives. The most customary methods of eliminating two vicinal halogen atoms in halopropionic acids to form a double bond use metals as dehalogenating agents, the greatest importance being attached to zinc, which is employed in various forms and activities. However, the reactions using zinc frequently proceed so slowly that it is necessary to work in higher-boiling solvents such as dimethylformamide or in diphenyl ether in the presence of thiourea. An additional disadvantage, in particular for industrial implementation, is that the production of metal salts is associated with the use of metals as the dehalogenating reagent.

Dibromopropionic acid dehalogenating methods using sodium sulfide in dimethylformamide also necessarily produce salts.

One way of avoiding the formation of metal salts during dehalogenation is offered by electrochemical dehalogenation. However, the effors hitherto to simultaneously eliminate two vicinal halogen atoms from halogenated propionic acids by electrochemical means were mainly of analytical nature and were carried out, for example, with the aid of polarographic or cyclovoltammetric methods at mercury electrodes or glass-carbon electrodes (J. Am. Chem. Soc. 80, 5402 (1959); J. Chem. Research (M) 1983, 2401). Here, conclusions were drawn on the production of unsaturated products merely from the curve shape or from the consumption of charge, or obvious formation of low-molecular-weight polymerization was attributed to interim formation of unsaturated compounds.

Few of the preparative electrolyses which have been disclosed hitherto were carried out at a mercury cathode with potential control and produced, in addition to unsaturated compounds, significant amounts of hydrogenated and polymerized products (J. Chem. Research (M) 1983, 2401).

Thus, it has hitherto not been possible to convert halogenated propionic acid derivatives into acrylic acid derivatives by electrochemical means without significant losses due to hydrogenation of the double bond and polymerization having to be accepted. In addition, the methods described hitherto, such as the use of potential control during electrolysis or the use of mercury as the electrode material, are unsuitable for industrial use from economic or physical and toxicological points of view. Furthermore, unsatisfactory electrolysis results have been achieved in as much as only incomplete conversion has been achieved and further, unknown products have been formed in addition to large amounts of hydrogenated products.

The object was therefore to provide an industrially feasible and economic process by means of which halogen atoms can be eliminated from fluorine-containing halopropionic acids or derivatives thereof by electrochemical means with formation of fluorine-containing acrylic acids without losses due to polymerization or saturation of the acrylic acid double bond occurring and without unavoidable production of metal halides being associated therewith.

It has been found that this object can be achieved by carrying out the electrochemical dehalogenation under galvanostatic conditions in water, optionally in the presence of an auxiliary solvent and/or a salt of a metal, at a hydrogen overvoltage of greater than 0.25 V.

The invention thus relates to the process described in the claims.

In the process according to the invention, compounds of the formula II

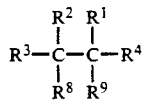

(II)

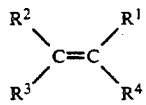

(I)

are subjected to electrolytic reduction, giving compounds of the formula I. In these formulae, $R^1$ denotes a fluorine atom or a methyl or deuteromethyl group, preferably a fluorine atom, $R^2$ and $R^3$ are identical or different and denote a fluorine, chlorine, bromine or iodine atom or a hydrogen or deuterium atom, $R^4$ denotes a cyano group or the

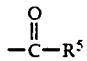

group, where $R^5$ is —OH, —OD, —OMe where Me=an alkali metal ion, an alkaline-earth metal ion or an $NH_4^+$ ion, $C_1$–$C_{12}$-alkoxy, preferably $C_1$–$C_6$-alkoxy, or —$NR^6R^7$ in which $R^6$ and $R^7$ are identical or different and denote H, D, $C_1$–$C_{12}$-alkyl, preferably $C_1$–$C_6$-alkyl, or phenyl. $R^5$ is preferably —OH, —OD or —OMe where Me=an alkali metal ion or an $NH_4^+$ ion, or $C_1$–$C_6$-alkoxy, in particular —OH, —OD or $C_1$–$C_6$-alkoxy, and $R^8$ and $R^9$ are identical or different and denote a chlorine, bromine or iodine atom.

Suitable starting substances are, inter alia, the following compounds and the esters, amides, nitriles and salts thereof:

Perhalogenated propionic acids, such as 2,3-dichloro-2,3,3-trifluoropropionic acid, 2,3-dibromo-2,3,3-trifluoropropionic acid, 2-bromo-3-chloro-2,3,3-trifluoropropionic acid, 3-bromo-2-chloro-2,3,3-trifluoropropionic acid, 2,2,3-trichloro-3,3-difluoropropionic acid, 2,2,3-trichloro-3,3-difluoropropionic acid and 2,3,3,3-tetrachloro-2-fluoropropionic acid, preferably 2,3-dibromo-2,3,3-trifluoropropionic acid, 2,3,3-trichloro-2,3-difluoropropionic acid and 2,3,3,3-tetrachloro-2-fluoropropionic acid, in particular 2,3,3,3-tetrachloro-2-fluoropropionic acid;

Partly halogenated propionic acids and the deuterated analogs thereof, such as 2,3-dibromo-2,3-difluoropropionic acid, 2,3-dibromo-3,3-difluoropropionic acid, 2,3,3-trichloro-2-fluoropropionic acid, 3-bromo-2,3-dichloro-2-fluoropropionic acid, 2-bromo-2,3-dichloro-3-fluoropropionic acid, 2,3,3-trichloro-3-fluoropropionic acid, 2,3-dibromo-2-fluoropropionic acid, 2,3-dichloro-2-fluoropropionic acid and 3-bromo-2-chloro-2-fluoropropionic acid, preferably 2,3-dibromo-2,3-difluoropropionic acid and 2,3-dibromo-2-fluoropropionic acid;

halogenated 2-methylpropionic acids, such as 2,3-dichlor-3,3-difluoro-2-methylpropionic acid and 2-bromo-3-chloro-3-fluoro-2-methylpropionic acid.

The process according to the invention is carried out in divided or undivided cells. For dividing the cells into anode and cathode chambers, the customary electrolyte-stable diaphragms made from polymers, preferably perfluorinated polymers, or from other organic or inorganic materials, such as, for example, glass or ceramic, but preferably ion exchanger membranes, are used. Preferred ion exchanger membranes are cation exchanger membranes made from polymers, preferably perfluorinated polymers containing carboxyl and/or sulfonic acid groups. The use of stable anion exchanger membranes is likewise possible.

The electrolysis can be carried out in any customary electrolysis cell, such as, for example, in a beaker cell or a plate-and-frame cell or in a cell having fixed bed or fluidized bed electrodes. Both monopolar and bipolar switching of the electrodes can be used.

It is possible to carry out the electrolysis either continuously or batchwise. A particularly expedient procedure is that in a divided electrolysis cell with the cathode reaction being carried out batchwise and the anode reaction continuously.

The electrolysis can be carried out at any electrolysis-stable cathode. Suitable materials are, in particular, those having a moderate to high hydrogen overvoltage, such as, for example, Pb, Cd, Zn, carbon, Cu, Sn, Zr and mercury compounds, such as copper amalgam, lead amalgam etc., but also alloys, such as, for example, lead/tin or zinc/cadmium. The use of carbon cathodes is preferred, in particular in electrolysis in an acidic electrolyte, since some of the abovementioned electrode materials, for example, Zn, Sn, Cd and Pb, can suffer from corrosion. In principle, all possible carbon electrode materials are suitable as the carbon cathodes, such as, for example, electrode graphites, impregnated graphite materials, carbon felts and also glassy carbon.

The anode materials used can be any material at which anode reactions which are known per se proceed. Examples are lead, lead oxide on lead or other supports, platinum, or noble metal oxides, for example, platinum oxide, doped titanium dioxide on titanium or other materials for oxygen evolution from dilute sulfuric acid or carbon or noble metal oxide-doped titanium dioxide on titanium or other materials for evolution of chlorine from aqueous alkali metal chloride solutions or aqueous or alcoholic hydrogen chloride solutions.

Preferred anolyte liquids are aqueous mineral acids or solutions of their salts, such as, for example, dilute sulfuric acid, concentrated hydrochloric acid, sodium sulfate solutions or sodium chloride solutions, and solutions of hydrogen chloride in alcohol.

The electrolyte in an undivided cell or the catholyte in a divided cell contains 0 to 100% of water and 100 to 0% of one or more organic solvents.

Examples of suitable solvents are:

Short-chain, aliphatic alcohols, such as methanol, ethanol, propanol or butanol, diols, such as ethylene glycol, propanediol, but also polyethylene glycols and the ethers thereof, ethers, such as tetrahydrofuran and dioxane, amides, such as N,N-dimethylformamide, hexamethylphosphoric triamide and N-methyl-2-pyrrolidone, nitriles, such as acetonitrile and propionitrile, ketones, such as acetone, and other solvents, such as, for example, dimethyl sulfoxide and sulfolane. The use of organic acids, such as, for example, acetic acid, is also possible.

However, the electrolyte can also comprise water and a water-insoluble organic solvent, such as t-butyl methyl ether or methylene chloride, in combination with a phase-transfer catalyst.

In order to produce the pH of 0 to 12, preferably 0.5 to 11, which is most favorable for electrolysis and to increase the conductivity, inorganic or organic acids, preferably acids such as hydrochloric acid, boric acid, phosphoric acid, sulfuric acid or tetrafluoroboric acid and/or formic acid, acetic acid or citric acid, and/or the salts thereof, can be added to the catholyte in a divided cell or to the electrolyte in a undivided cell.

The addition of organic bases may also be necessary to produce the pH which is favorable for electrolysis and/or may favorably affect the course of the electrolysis. Primary, secondary or tertiary $C_2$–$C_{12}$-alkylamines or cycloalkylamines, aromatic or aliphatic-aromatic amines or the salts thereof, inorganic bases, such as alkali metal hydroxides or alkaline-earth metal hydroxides, such as, for example, the hydroxides of Li, Na, K, Cs, Mg, Ca and Ba, quaternary ammonium salts, with anions such as, for example, the fluorides, chlorides, bromides, iodides, acetates, sulfates, hydrogen sulfates, tetrafluoroborates, phosphates or hydroxides, and with cations such as, for example, $C_1$–$C_{12}$-tetraalkylammonium, $C_1$–$C_{12}$-trialkylarylammonium or $C_1$–$C_{12}$-trialkylalkylarylammonium, but also anionic or cationic emulsifiers, in amounts from 0.01 to 25 per cent by weight, preferably 0.03 to 20 per cent by weight, relative to the total amount of the electrolyte or catholyte, are suitable.

During the electrolysis in an undivided cell, compounds which are oxidized at a more negative potential than the halogen ions liberated can be added to the electrolyte in order to prevent the production of free halogen. The salts of oxalic acid, methoxyacetic acid, glyoxylic acid, formic and/or hydrazoic acid, for example, are suitable.

In addition, salts of metals having a hydrogen overvoltage of at least 0.25 V (based on a current density of 300 mA/cm$^2$) and/or having dehalogenating properties can be added to the electrolyte in an undivided cell or to the catholyte in a divided cell. Suitable salts are primarily the soluble salts of Cu, Ag, Au, Zn, Cd, Hg, Sn, Pb, Tl, Ti, Zr, Bi, V, Ta, Cr or Ni, preferably the soluble salts of Pb, Zn, Cd, Ag and Cr. The preferred anions of these salts are $Cl^-$, $SO_4^{--}$, $NO_3^-$ and $CH_3COO^-$.

The salts can be added directly to the electrolysis solution or generated in the solution, for example by adding oxides, carbonates etc. — in some cases also the metals themselves (if they are soluble).

The salt concentration in the electrolyte in an undivided cell and in the catholyte in a divided cell is expediently adjusted to about $10^{-5}$ to 10% by weight, preferably to about $10^{-3}$ to 5% by weight, in each case relative to the total amount of the electrolyte or catholyte.

The electrolysis is carried out at a current density between 1 and 600 mA/cm$^2$, preferably at 10 to 500 mA/cm$^2$, without potential control.

The electrolysis temperature is in the range −10° C. to the boiling point of the electrolyte liquid, preferably 10° to 90° C., in particular 15° C. to 80° C.

The electrolysis product is worked up in a known manner, for example by extraction or removal of the solvent by distillation. The compounds added to the catholyte can thus be returned to the process.

The process according to the invention is illustrated in greater detail below by means of examples.

By means of a comparison example, it is shown that a mercury cathode, as described in J. Am. Chem. Soc. 80, 5402, 1959, and J. Chem. Research (M) 1983, 2401, is unsuitable for selective dehalogenation without formation of polymers or saturated products.

EXAMPLES

Electrolysis cell 1: Jacketed glass cell of capacity 350 cm$^3$
Anode: Platinum mesh, graphite or lead plate (20 cm$^2$)
Cathode surface area: 12 cm$^2$
Current density: 83 mA/cm$^2$
Electrode separation: 1.5 cm
Terminal voltage: 6–5 V
Anolyte: dilute aqueous sulfuric acid or methanolic hydrochloric acid
Cation exchanger membrane: single-layer membrane made from a copolymer of a perfluorosulfonyl ethoxyvinyl ether and tetrafluoroethylene
Substance transport: by magnetic stirrer
Electrolysis cell 2: Jacketed glass circulation cell of capacity 450 cm$^3$
Anode: Platinum mesh, graphite or lead plate (20 cm$^2$)
Cathode surface area: 12 cm$^2$
Electrode separation: 1 cm
Anolyte: dilute aqueous sulfuric acid or methanolic hydrochloric acid
Cation exchanger membrane as in electrolysis cell 1
Current density: 83 mA/cm$^2$
Terminal voltage: 5 V

| Examples | 1 | 2 | 3 | 4 | 5 | 6 |
|---|---|---|---|---|---|---|
| Cathode | impregnated graphite | | | Lead sheet | impregnated graphite | |
| Electrolysis cell | 1 | 2 | 1 | 1 | 1 | 1 |
| Initial electrolyte (g) | | | | | | |
| $H_2O$ | 200 | 350 | 200 | 250 | 200 | — |
| $CH_3OH$ | — | — | — | — | — | 200 |
| DMF | — | — | 50 | — | — | — |
| $Pb(OAc)_2$ | — | 0.5 | — | — | — | 0.5 |
| $AgNO_3$ | 0.5 | — | — | — | — | — |
| $Ni(NO_3)_2$ | — | — | — | — | 0.5 | — |
| NaOH | 0.5 | 0.5 | — | — | 0.5 | — |
| $(CH_3)_4N^+CL^-$ | — | — | — | — | — | 1 |
| $CCL_2F—CFCL—COOH$ | 10 | 10 | 10 | 10 | 10 | 10 |
| Flow rate dm$^3$/h | — | 60 | — | — | — | — |
| Temperature °C. | 60 | 58 | 35 | 32 | 32 | 33 |
| Current consumption (Ah) | 4.62 | 4.26 | 4.26 | 4.26 | 4.26 | 4.26 |
| Electrolysis result (%) | | | | | | |
| $CCL_2F—CCLF—COOH$ | 0.18 | 0.15 | 0.65 | 0.16 | 0.56 | 1.24 |
| $CCLF=CF—COOH$ | 5.89 | 4.17 | 4.85 | 5.06 | 4.52 | 4.66 |
| | (87.6) | (63.6) | (79.1) | (76.9) | (74.4) | (80.5) |
| $HCF=CF—COOH$ | 0.19 | — | — | — | — | — |
| | (1.8) | | | | 1.1 | |
| pH | 0.73 | 0.7 | 0.75 | 0.8 | 2.8 | 0.6 |

1 Current denisty 240 mA/cm$^2$; terminal voltage 13.6 V

EXAMPLE 7

Electrolysis cell 1:
Cathode: impregnated graphite
Initial electrolyte:
250 g of $H_2O$
5 g of $CCl_3—CClF—COOH$
0.4 g of $Pb(OAc)_2 . 2H_2O$
0.4 g of NaOH
Temperature: 32° C.
Current density: 249 mA/cm$^2$
Terminal voltage: 7–4.8 V
Current consumption: 1.17 Ah
Electrolysis result:
$CCl_2=CF—COOH$ 3.4 g (97.2%)
$CHCl=CF—COOH$ 0.1 g (2.1%)
pH: 0.85

EXAMPLE 8

Electrolysis cell 1:

Cathode: impregnated graphite
Initial electrolyte:
150 $cm^3$ of acetone
10 g of tetrabutylammonium hydrogen sulfate
20 g of $CF_2Br—CFBr—COOCH_3$
Temperature: 30°-35° C.
Current density: 42 $mA/cm^2$
Terminal voltage: 40-32 V
Current consumption: 3.57 Ah
Electrolysis result:
$CF_2Br—CFBr—COOCH_3$ 4.19 g
$CF_2=CF—COOCH_3$ 5.42 g (73.4%)

COMPARISON EXAMPLE

Electrolysis cell 1
Cathode: pool of mercury
Initial electrolyte:
200 $cm^3$ of water
0.5 g of NaOH
1.3 g of $CCl_3—CFCl—COOH$
Temperature: 32° C.
Current density: 28 $mA/cm^2$
Terminal voltage: 20-22 V
Current consumption: 0.3 Ah
pH: 3.15-2.2
Electrolysis result:
$CCl_3—CFCl—COOH$ 0.428 g
$CCl_2=CF—COOH$ 0.206 g
$CHCl=CF—COOH$ 0.204 g
$CHCl_2—CFCl—COOH$ 0.131 g
unknown products 0.022 g.

We claim:

1. A process for the preparation of compounds of the formula I

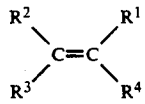

(I)

in which $R^1$ denotes a fluorine atom or a methyl or deuteromethyl group, $R^2$ and $R^3$ are identical or different and denote a fluorine, chlorine, bromine, iodine, hydrogen or deuterium atom, and $R^4$ is a cyano group or the

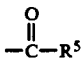

group where $R^5$ denotes —OH, —OD, —OMe where Me=an alkali metal ion, an alkaline-earth metal ion or an $NH_4+$ ion, $C_1$ to $C_{12}$-alkoxy or $—NR^6R^7$ in which $R^6$ and $R^7$ are identical or different and represent H, D, $C_1$ to $C_{12}$-alkyl or phenyl, by electrolytic reduction, wherein compounds of the formula II

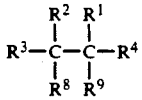

(II)

in which $R^1$, $R^2$, $R^3$ and $R^4$ have the abovementioned meaning and $R^8$ and $R^9$ are identical or different and denote a chlorine, bromine or iodine atom, in an undivided cell or a divided cell in an electrolysis liquid comprising—in each case relative to the total amount of the electrolyte in an undivided cell or the catholyte in a divided cell—

0 to 100% by weight of water 100 to 0% by weight of one or more organic solvents, and 0 to 10% by weight of a salt of a metal having a hydrogen overvoltage of at least 0.25 V (based on a current density of 300 $mA/cm^2$) and/or having dehalogenating properties, are subjected to electrolysis at a temperature from −10° C. to the boiling point of the electrolysis liquid and galvanostatically at a current density between 1 and 600 $mA/cm^2$, the cathode comprising lead, cadmium, zinc, copper, tin, zirconium or carbon wherein the resulting fluorine-containing acrylic acid remains in the unsaturated form in the catholyte.

2. The process as claimed in claim 1, wherein the electrolysis is carried out at a pH from 0 to 11 in the electrolyte in an undivided cell or in the catholyte in a divided cell.

3. The process as claimed in claim 1, wherein 2,3-dibromo-2,3,3-trifluoropropionic acid, 2,3,3-trichloro-2,3-difluoropropionic acid, 2,3,3,3-tetrachloro-2-fluoropropionic acid, 2,3-dibromo-2,3-difluoropropionic acid or 2,3-dibromo-2-fluoropropionic acid or the derivatives thereof, is subjected to electrolysis.

4. The process as claimed in claim 1, wherein the electrolysis is carried out at a temperature from 10° to 90° C.

5. The process as claimed in claim 1, wherein the electrolysis is carried out at a current density between 10 and 500 $mA/cm^2$.

6. The process as claimed in claim 1, wherein the electrolysis is carried out in a divided cell with a batchwise cathode reaction and a continuous anode reaction.

7. The process as claimed in claim 1, wherein the electrolysis is carried out in an undivided cell.

8. The process as claimed in claim 1, wherein the electrolysis is carried out using a carbon cathode.

9. The process as claimed in claim 1, wherein a soluble salt of copper, silver, gold, zinc, cadmium, mercury, tin, lead, thallium, titanium, zirconium, bismuth, vanadium, tantalum, chromium, cerium, cobalt or nickel is present in a concentration from about $10^{-5}$ to 10% by weight, relative to the total amount of the electrolyte or catholyte.

10. The process as claimed in claim 1, wherein said electrolysis is carried out in an acidic reaction medium.

* * * * *